United States Patent [19]

Morgan

[11] 4,411,033

[45] Oct. 25, 1983

[54] WAVELESS WATERBED

[75] Inventor: Charles W. Morgan, Rolling Hills, Calif.

[73] Assignee: United Foam Corporation, Lynwood, Calif.

[21] Appl. No.: 191,169

[22] Filed: Sep. 26, 1980

Related U.S. Application Data

[63] Continuation-in-part of Ser. No. 59,783, Jul. 23, 1979, abandoned.

[51] Int. Cl.[3] ..... A47C 27/08

[52] U.S. Cl. ..... 5/450; 5/451; 428/317.9

[58] Field of Search ..... 5/451, 452, 449, 450, 5/422; 428/317.9

[56] References Cited

U.S. PATENT DOCUMENTS

| | | | |
|---|---|---|---|
| 3,258,791 | 7/1966 | Kaplan | 5/481 |
| 3,349,953 | 10/1967 | Conaway | 220/5 |
| 3,428,599 | 5/1982 | Mollura | 5/451 |
| 3,574,873 | 4/1971 | Weinstein | 5/450 |
| 3,585,356 | 6/1971 | Hall | 5/422 |
| 3,600,726 | 8/1971 | Williams | 5/450 |
| 3,611,455 | 10/1971 | Gottfried | 5/450 |
| 3,702,484 | 11/1972 | Tobinick et al. | 5/451 |
| 3,736,604 | 6/1973 | Carson | 5/451 |
| 3,748,669 | 7/1973 | Warner | 5/450 |
| 3,787,908 | 1/1974 | Beck et al. | 5/451 |
| 3,810,265 | 5/1974 | McGrew | 5/451 |
| 3,872,525 | 3/1975 | Lea et al. | 5/450 |
| 3,939,508 | 2/1976 | Hall et al. | 5/481 |
| 4,086,675 | 5/1978 | Talbert et al. | 5/481 |
| 4,141,770 | 2/1979 | Mollura | 5/451 |
| 4,152,796 | 5/1979 | Fogel | 5/451 |
| 4,190,916 | 3/1980 | McMullan | 5/451 |
| 4,192,031 | 3/1980 | Fogel | 5/451 |
| 4,247,962 | 2/1981 | Hall | 5/451 |
| 4,256,803 | 3/1981 | Savey et al. | 428/317.9 |
| 4,269,889 | 5/1981 | Takagi | 428/317.9 |
| 4,332,043 | 6/1982 | Larson | 5/451 |
| 4,345,348 | 8/1982 | Hall | 5/450 |

FOREIGN PATENT DOCUMENTS

| | | | |
|---|---|---|---|
| 2431431 | 1/1976 | Fed. Rep. of Germany | 5/451 |
| 608951 | 2/1979 | Switzerland | 5/451 |

*Primary Examiner*—Alexander Grosz

*Attorney, Agent, or Firm*—Blakely, Sokoloff, Taylor & Zafman

[57] ABSTRACT

The present invention is a waterbed mattress having a slab of substantially open celled foam or cellulosic sponge substantially submerged in the liquid fill of the mattress. The waterbed mattress of the present invention retains the positive qualities of bouyant support and comfort of conventional waterbed mattresses, and reduces the undesired wave motion often created within the mattress. Other embodiments of the present invention include a waterbed mattress having a large number of substantially open celled foam or cellulosic sponge particles which are substantially submerged in, yet partially suspended at the upper surface of, the mattress's liquid fill, such particles being either enclosed in a gauze-like sack or unenclosed within the mattress. The present invention may be incorporated in waterbeds or other body supporting furniture such as chairs and couches in which a liquid fill medium is used.

30 Claims, 11 Drawing Figures

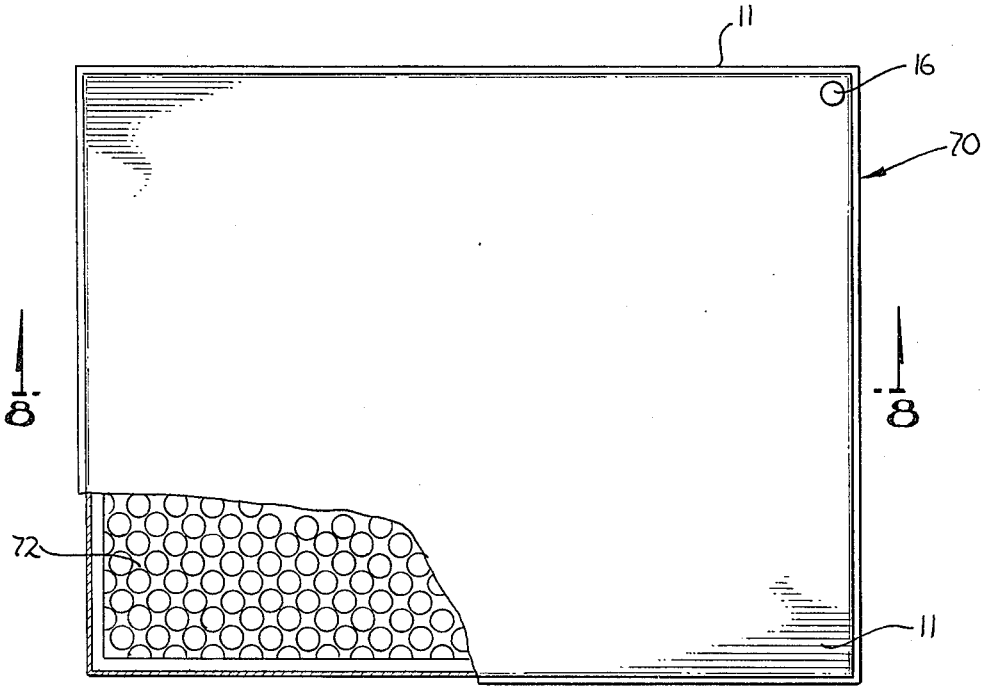
Fig. 7
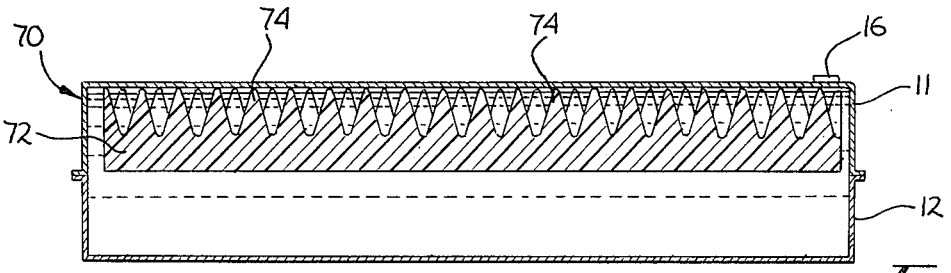
Fig. 8
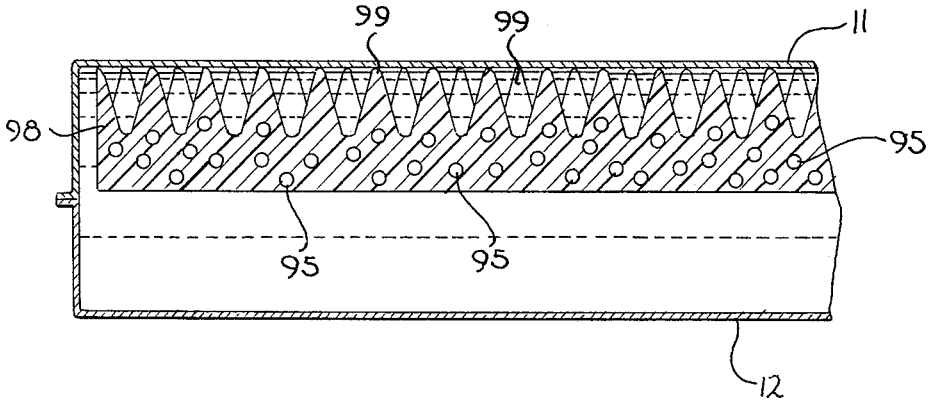

WAVELESS WATERBED

CROSS REFERENCE TO RELATED APPLICATION

This application is a continuation-in-part of U.S. Pat. application Ser. No. 06/059,783, filed July 23, 1979 now abandoned.

BACKGROUND OF THE INVENTION

1. Field of the Invention

This invention relates to waterbed mattresses.

2. Prior Art

Since the late 1960's, when waterbeds were first introduced, waterbeds have been gaining increasing acceptance. It has been recognized that waterbeds provide dimensions of comfort and bodily support not available from conventional inner spring or foam mattress bedding systems. Waterbeds have also become favored for their therapeutic and other user qualities.

However, waterbeds have been beset with a major disadvantage. This disadvantage is the tendency for wave motion to be created in the waterbed mattress. Wave motion in the mattress can make users of the waterbed uncomfortable, and consumer fear of "seasickness" has inhibited the acceptance of waterbeds.

Heretofore, attempts have been made to provide a waterbed mattress that would retard or dampen wave motion. The June, 1979 issue of *California Business,* in an article by Bob Gilbert entitled "Taking the Plunge" (p.54), reports at page 60 that it was hoped "hybrid" beds would solve this wave motion problem. A hybrid bed comprises a water mattress with a foam topping placed over the mattress. Unfortunately, hybrid beds are as susceptible to wave motion as conventional waterbeds.

The same article reports, also at page 60, that attempts to achieve motionless characteristics include putting plastic baffles inside the waterbed mattress, and "floating a jell on the top half of a mattress, separated from water on the bottom half by a vinyl sheet."

Another recent attempt to reduce wave motion includes construction of baffle chambers within the mattress. The chambers' side panels are welded to the mattress' bottom sheet. The chambers' tops, connected to the upper edges of the side panels, are made of foam and allowed to float free of any contact with the mattress in an effort to form an internal breakwater.

The above discussed attempts to reduce wave motion have met with various degrees of success. Unfortunately, whatever degree of wave dampening achieved by such systems has often been more than offset by increased costs and complexities of manufacture. Moreover, such systems are often expensive to ship, and they pose difficulties to consumers who wish to empty, reposition, and refill their waterbeds. Some systems are more prone to leakage. Waterbed systems requiring special gels or additives cause additional problems and expenses. For example, special kits are needed to dissolve the gel for draining. Also, conventional heaters cannot be used with waterbed mattresses containing gels because of the poor heat transfer properties of gels. When conventional heaters are used in connection with waterbeds comprising gels, the heaters have been known to burn out and the vinyl comprising the mattress has been known to melt.

U.S. Pat. Nos. 3,702,484 and 3,736,604, issued to R. Carson, Jr., and to S. Tobonick and A. Saminoff, respectively, disclose hybrid type waterbeds.

Waterbed mattresses comprising baffles to dampen wave motion are disclosed in C. Mollura's U.S. Pat. No. 4,141,770 and I. Fogel's U.S. Pat. No. 4,152,796. Also, U.S. Pat. No. 4,192,031, issued to I. Fogel is illustrative of such waterbeds comprising baffle chambers. In Fogel '031, the foam is preferably closed cell foam and in any event is thin and serves as a float or "cork" to support the baffle chambers' top. The Fogel '031 baffle achieves wave reduction as a result of the top of the chamber wiping against the upper sheet of the waterbed. Such a waterbed is still subject to violent movement, though for a shorter time than conventional waterbeds. Because the baffle's side panels are welded, or heat sealed, to the bottom sheet of the mattress, such mattress is more susceptible to leakage.

U.S. Pat. No. 3,349,953, issued to R. Conaway and J. Spindler discloses a tank with a baffle system inserted to prevent sloshing of liquid in the tank.

U.S. Pat. No. 3,748,669, issued to F. Warner, discloses a waterbed mattress comprising fluid impervious cells distributed throughout the mattress to displace liquid which would otherwise be required to fill the mattress, thus, reducing the total weight of the mattress. German Offenlegungsschrift No. 2,431,431, issued to Mr. Schmidt shows a similar waterbed mattress. U.S. Pat. No. 3,787,908, issued to W. Beck and N. Sweeny, also discloses a liquid filled mattress having low density cellular particles suspended throughout the liquid in order to reduce the weight of the filled mattress. The cellular particles also improve the insulative properties of the liquid fill. Beck et al. also teach adding a viscosity modifier to the liquid fill to improve the waterbed mattress's dimensional stability characteristics.

U.S. Pat. No. 3,585,356,issued to C. Hall, discloses producing a dampening effect by placing a suitable solid material in suspension in the fluid within the mattress. Hall teaches that ground or shredded Styrofoam at a volume ratio of about one to three to water produces a dampening effect. Hall also teaches replacing the Styrofoam by starch or other material which will stay in suspension in the fluid. An alternative embodiment is also shown by Hall, wherein small blocks of a material such as styrofoam float upon the entire surface of the fluid. Hall teaches that the blocks rub against each other and their reaction with the fluid provides independent support for all parts of a body positioned on the waterbed mattress.

D. McGrew, in U.S. Pat. No. 3,810,265, teaches dampening wave motion by adding a water soluble viscosity increasing agent to the liquid fill of the mattress. McGrew also discusses the preference that the water mattress not be secured to the frame, especially along the upper marginal surface of the mattress to insure preservation of even bouyancy and prevention of a shear-producing hammocking effect. For this purpose the upper surface of the mattress may carry some slack as provided by a plurality of pleats in the upper mattress surface. Additionally, a foam rubber or other elastic pad may be floatably positioned on the upper outside mattress surface for added comfort or temperature compensation.

U.S. Pat. No. 3,574,873, issued to J. Weinstein, discloses a cushion for preventing the formation of decubitus ulcers. The cushion comprises a flexible and elastic envelope surrounding and enclosing an internal matrix formed of open cell foam material. The internal matrix occupies the entire depth of the envelope. At suitable places the upper surface of the envelope is bonded to the top surfaces of the foam matrix. The envelope also encloses a fluid which passes through the open cells of the foam. This fluid is usually air, although water may be used in addition to air to help dissipate heat in the cushion. Weinstein teaches filling the $\frac{2}{3}$ of the cushion's volume with water and to have the remaining $\frac{1}{3}$ as air at atmospheric pressure. Weinstein also teaches filling the cushion completely with water. However, since the matrix is relatively inelastic, a stiffer cushion results when it is filled completely with water. At no time is Weinstein concerned with the formation of waves in his cushions as the cushion does not contain enough water for waves to become a factor.

The systems described by the above discussed patents have not achieved a satisfactory wave dampening effect without compromising the qualities expected of conventional waterbeds. Moreover, such systems bear the disadvantages discussed earlier; namely, increased costs and complexities of manufacture, increased costs of shipping, increased difficulties in emptying and refilling, greater likelihood of leakage, and increased maintenance costs.

SUMMARY OF THE INVENTION

The present invention is a waterbed mattress having a slab of substantially open celled foam or cellulosic sponge substantially submerged in the liquid fill of the mattress. The waterbed mattress of the present invention retains the positive qualities of bouyant support and comfort of conventional waterbed mattresses, and reduces the undesired wave motion often created within the mattress. Other embodiments of the present invention include a waterbed mattress having a large number of substantially open celled foam or cellulosic sponge particles which are substantially submerged in, yet partially suspended at the upper surface of, the mattress's liquid fill, such particles being either enclosed in a gauze-like sack or unenclosed within the mattress. The present invention may be incorporated in waterbeds or other body supporting furniture such as chairs and couches in which a liquid fill medium is used.

BRIEF DESCRIPTION OF THE DRAWINGS

FIG. 7 is a cutaway, top view of a fourth embodiment of the present invention.

FIG. 8 is a side, sectional view of the present invention taken along line 8—8 of FIG. 7.

FIG. 9 is a side sectional view of the present invention showing a slab having a low specific gravity material disposed throughout. A slab with such low specific gravity material disposed in it may be used in any of the embodiments shown in FIGS. 1–8.

DETAILED DESCRIPTION OF THE INVENTION

In the following discussion, the same numeral will designate like elements throughout the drawings. For example, in FIGS. 1 through 11, which illustrate preferred embodiments of this invention, the upper and lower sheets of the waterbed mattress are designated, respectively, by numbers 11 and 12 throughout. While this description often refers to "water" as the liquid fill for the invented waterbed mattress, it should be understood that the present invention contemplates other liquids such as aqueous compositions containing germicides, fungicides, viscosity modifiers and/or additives for enhanced heat transfer.

The present invention incorporates many of the elements of conventional waterbed technology. Sheets 11 and 12 are typically vinyl sheets joined together by a heat seal 14 to form a fluid retaining compartment. The mattress has a standard valve 16 to allow for the filling and emptying of the mattress.

Figure 1:
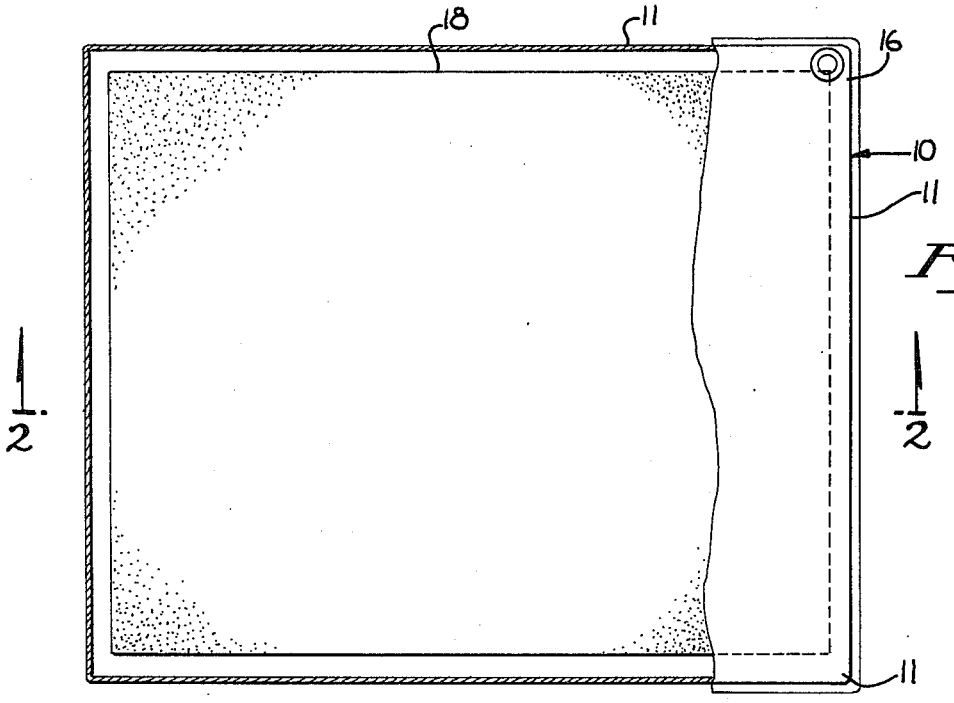
FIG. 1 is a cutaway, top view of an embodiment of the present invention.
Figure 2:
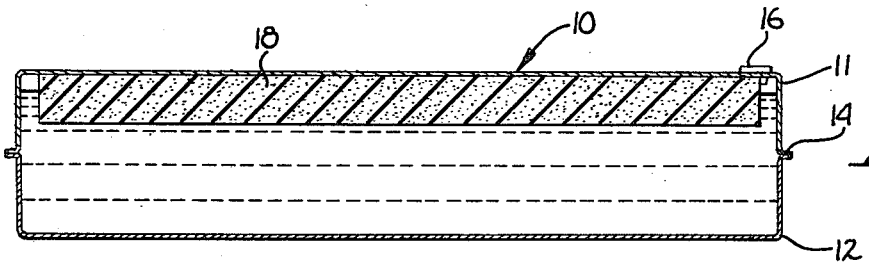
FIG. 2 is a side sectional view of the present invention taken along line 2—2 of FIG. 1.
Figure 3:
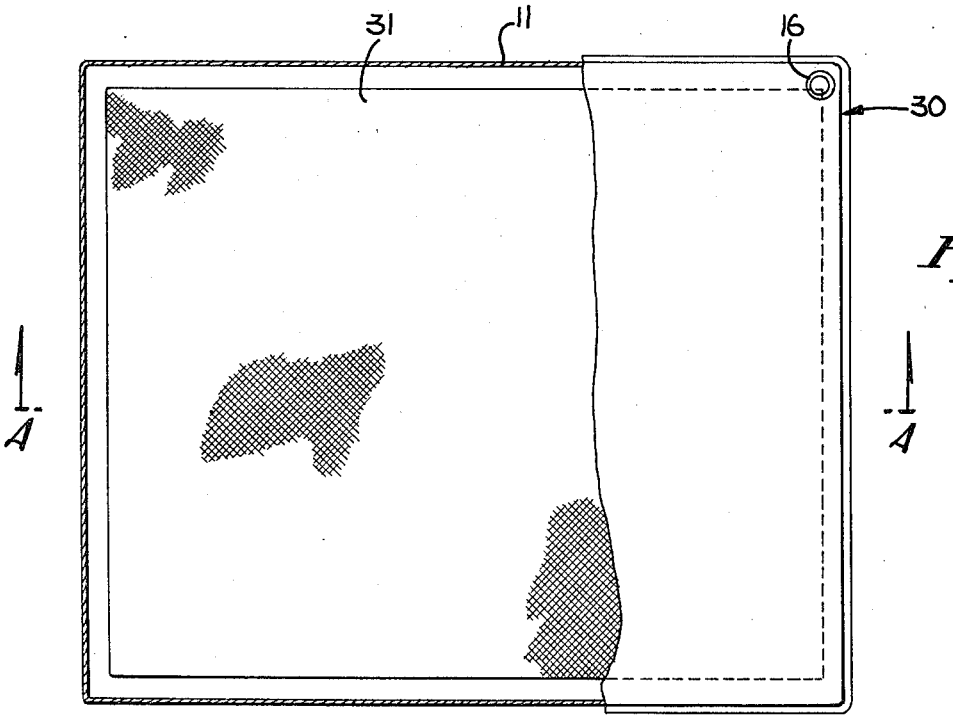
FIG. 3 is a cutaway, top view of another embodiment of the present invention.
Figure 4:
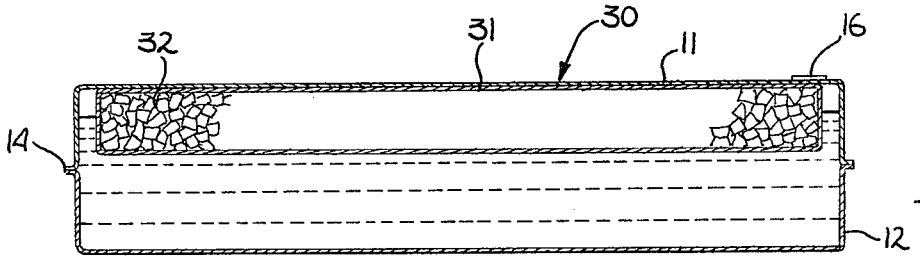
FIG. 4 is a side, sectional view of the present invention taken along line 4—4 of FIG. 3.

Referring to FIGS. 1 and 2, the diacritic feature of the present invention can be seen. Waterbed mattress or bladder 10 comprises a substantially open celled foam slab 18. This slab is disposed between sheets 11 and 12 before they are sealed together. The foam slab is diminished so that it substantially occupies the length and width of the waterbed mattress. The thickness of foam slab 18 should be between 20% and 80% of the depth of the filled mattress and is preferably between 40 to 60 percent of the depth of the filled mattress. For example, if the filled mattress is six (6) inches deep, foam slab 18 should preferably be about 2.4 to 3.6 inches thick to obtain optimum results. The cells of the foam are interconnected. Thus, water flows into and fills all the cells of that portion of the foam which is submerged.

Foam slab 18, besides being capable of being filled with water, is a soft resilient material, capable of flexing under body weight. In the preferred embodiment, the specific gravity of the foam should be such that it remains substantially submerged in, yet partially suspended at the surface of, the liquid when the mattress is filled (i.e., less than 1.0 for a water filled mattress). If the specific gravity of the foam is greater than the specific gravity of the liquid fill (e.g., if the liquid fill is water and the specific gravity of the foam is greater than 1.0), ground cork, glass spheres, micro-balloons such as phenolic, expandable polystyrene beads and other fillers having relatively low specific gravities (hereinafter sometimes referred to as "low specific gravity material") may be disposed throughout the slab as shown in FIG. 9 so that the slab has an overall specific gravity which is lower than the intended liquid fill of the waterbed mattress.

It should also be noted that cellulosic sponge, which is open celled and has a specific gravity of less than 1.0, may be used to form the slab.

When the foam slab is substantially saturated with water, its presence within the mattress is virtually undetectable. This is because slab 18 is soft, flexible, and when substantially saturated, mostly water. Moreover, in the preferred embodiments, the slab can be displaced downwards through a substantial distance of otherwise unoccupied water. Thus the bouyancy and physical characteristics of the waterbed of the present invention are nearly identical to that of a conventional waterbed mattress.

At the same time that the present invention retains the desirable qualities of conventional waterbed mattresses, it virtually eliminates the unappealing tendency of waterbed mattresses to be susceptible to the creation of large wave motion. With the water saturated foam slab occupying approximately the top half of the mattress, the water is free to move only in the bottom portion of the mattress. Thus, the amplitude of any wave motion at the top surface of the mattress is greatly reduced.

It has been found that the present invention not only retains the desirable qualities of a waterbed mattress while eliminating the susceptibility to wave motion. The present invention also improves upon the desirable qualities. In this regard, wave motion is not only dampened, it is also converted to a slow, gentle rocking motion. The present invention provides support which is actually more comfortable than that provided by a waterbed mattress containing only liquid fill. Users of the waterbed mattress of the present invention have said they feel more secure on such mattress. This added factor of comfort was a totally unexpected advantage.

The operation of the substantially water saturated foam slab may be viewed in another way. Because the water "trapped" in the foam is substantially restricted in movement and flow, the "viscosity" of the water in the upper half of the mattress can be viewed as being effectively increased many times over. While highly viscous water is known to dampen wave motion, increasing the viscosity of the liquid fill of a waterbed mattress has been known to degrade such mattress's bouyancy and other physical properties. Moreover, in some instances, increasing the viscosity of the liquid fill may change the thermal conductivity properties of the liquid fill, thus preventing proper heating of the mattress. The present invention retains the positive qualities of waterbeds because the effective viscosity of the water is only regionally modified, with about one half of the water being unaffected.

As discussed before, foam slab 18 is a substantially open celled foam material readily capable of being filled with water (or other liquid used to fill the mattress), and at the same time being partially suspended at the surface of the liquid fill. A preferred foam is polyurethane foam, although rubber, vinyl or neoprene foam is also satisfactory. The specific gravity of the foam slab 18 for a water filled mattress should be less than 1, and preferably in the range from 0.85 up to 1. To achieve such overall specific gravity, low specific gravity material such as ground cork, micro-balloons and the like may be disposed throughout the foam as discussed before and as shown in FIG. 9 (wherein slab 98 having low specific gravity material 95 disposed in it is illustrated). Foam slabs with different specific gravities, however, may be required for liquid fills which are heavier or lighter than water.

Polyurethane foam is graded for softness by the foam manufacturing industry on a scale known as the Indent Load Deflection scale (hereinafter referred to as "ILD"). On this scale, 8 is the softest, and numbers in the 100's indicate virtually rigid foam. Polyurethane foam is normally produced with an ILD number of about 45. Polyurethane foam for conventional mattresses has an ILD number of about 30. The foam used in the present invention preferably has an ILD number in the range of 8 to 24, although satisfactory results can be achieved with foam having an ILD number ranging into the low 50's.

The ILD number of the foam may be modified by injecting some expandable polystyrene beads or other low specific gravity material into the foam.

The foam material placed in the mattress need not be in slab form only. For example, waterbed mattress 30, illustrated in FIGS. 3 and 4, comprises a large number of different sized foam pieces 32. These pieces can be placed loosely in the mattress, or as shown, may be contained in a strong gauze-like or other suitable enclosure 31. As in the embodiment shown in FIGS. 1 and 2, it is preferred that the foam occupies between 40 and 60 percent of the depth of the expanded mattress.

Figure 5:
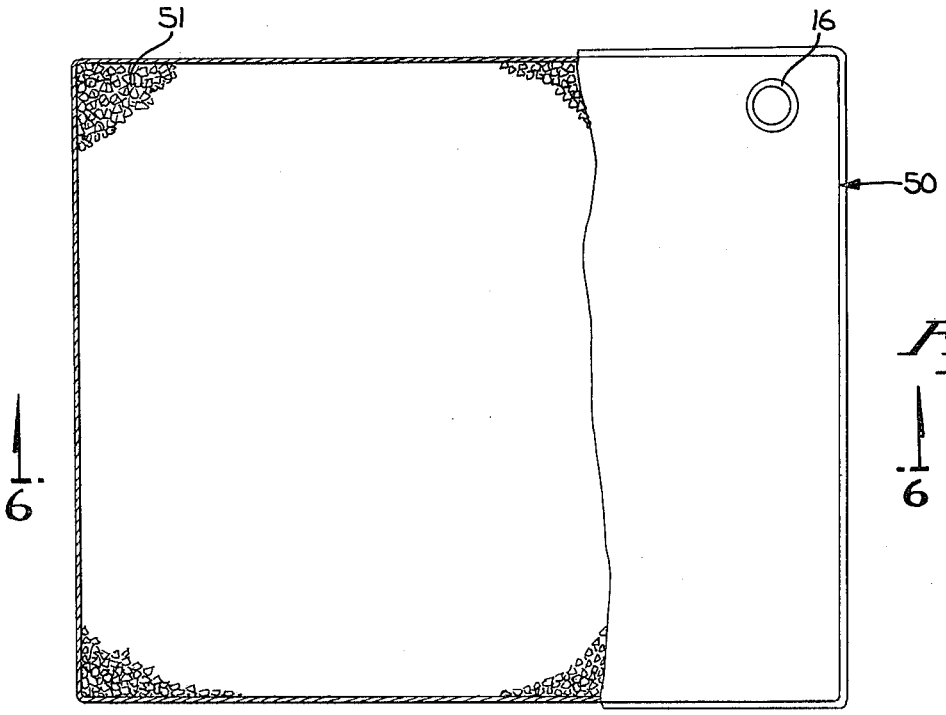
FIG. 5 is a cutaway, top view of still another embodiment of the present invention.
Figure 6:
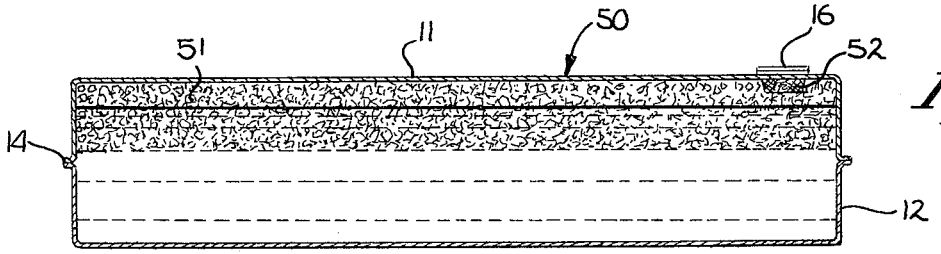
FIG. 6 is a side, sectional view of the present invention taken along line 6—6 of FIG. 5.

FIGS. 5 and 6 illustrate a similar embodiment. Mattress 50 contains within it many tiny foam particles 51 (typically less than about 0.25 inches in diameter). As in the other embodiments, the foam particles preferably occupy about 40 to 60 percent of the filled mattress. Such particles may be "blown" into the waterbed mattress 50 using conventional techniques for filling enclosures with foam particles. The foam particles 51 are shown as being unenclosed by a separate inner envelope or enclosure. Because the particles are not contained by a separate inner enclosure, valve 16 is fitted with screen 52 to prevent any of the particles from escaping during the filling or emptying of the mattress. If desired the particles 51 can be contained in a suitable envelope or enclosure in the same manner shown in FIGS. 3 and 4.

The mattresses shown in FIGS. 3 through 6 operate in substantially the same manner as the waterbed mattress having the foam slab inside of it. However, the second two embodiments offer the economic advantage of using foam scraps which might otherwise be discarded as waste material. Thus, these embodiments can be produced at much lower costs.

FIGS. 7 and 8 illustrate another embodiment of the invention. In this embodiment waterbed mattress 70 comprises a foam slab 72 which is of egg crate design. This foam slab is made of the same material as foam slab 18 and foam particles 32 and 51 of FIGS. 2, 4 and 6, respectively. That is, the foam is an open celled foam which may be polyurethane or rubber, vinyl or neoprene. The foam slab may also have low specific gravity material such as ground cork, micro-balloons and the like disposed throughout so that its overall specific gravity is less than the liquid fill. Also, the slab may be formed of cellulosic sponge instead of foam.

The embodiment comprising the egg crate design is preferred over the embodiment comprising slab 18, which is of rectangular cross section. This is because teats 74 extending upwards from the main body of slab 72 provide at the upper surface of the mattress a space in which some of the liquid fill is virtually trapped, yet at the same time can flow more freely within the space than liquid fill similarly situated in the embodiments illustrated in FIGS. 1–6. Thus, the feel of a conventional waterbed is even more closely reproduced while the secure feeling previously discussed is still maintained. Also, the improved support provided by the invention is present. In fact, to the extent that the upward extending teats soften the initial contact with the waterbed, the comfort qualities of the invention are even further improved.

Another beneficial feature of the embodiment shown in FIGS. 7 and 8 is that less material need be used to form slab 72 than is needed to form slab 18. For example, if teats 74 comprise about 50% of slab 74, two slabs 74, each having a total thickness of 4 inches, may be formed from a piece of foam material having a rectangular cross section of 6 inches in thickness. To form two slabs 18, each having a total thickness of 4 inches, a piece of 8 inch foam must be used. Thus, a savings of 25% in material is achieved. As the size of the teats increases in proportion to the total thickness of the slab, additional savings in material may be achieved.

A further advantage of the embodiment shown in FIGS. 7 and 8 is that the slab may be made of a more rigid material. For example, if polyurethane foam is used, the normally produced foam having an ILD of about 45 may be used. In fact, polyurethane foam having an ILD number into the 80s may be used.

Figure 10:
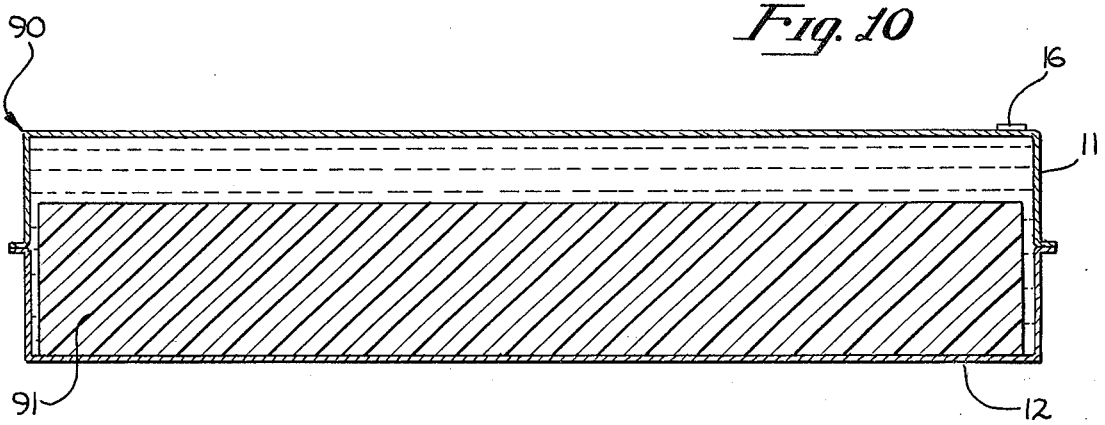
FIG. 10 is a side sectional view of another embodiment of the present invention.
Figure 11:
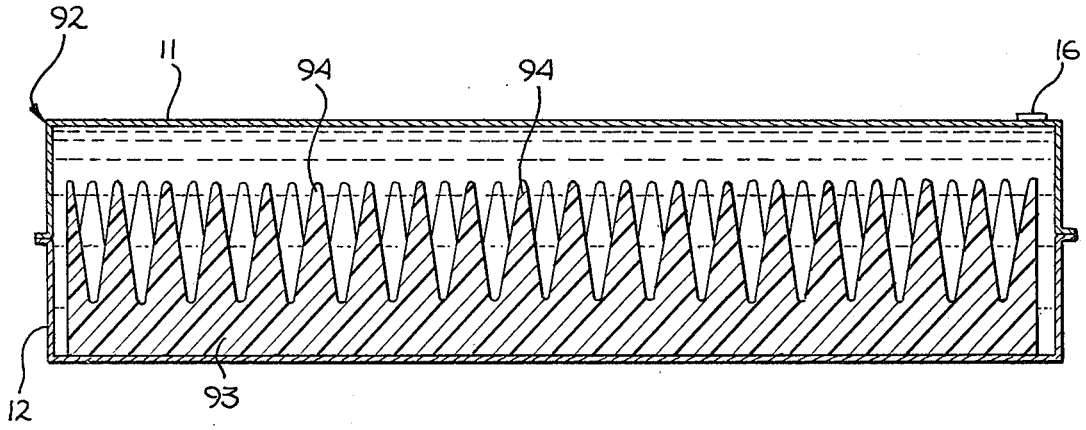
FIG. 11 is a side sectional view of a further embodiment of the present invention.

FIGS. 10 and 11 show two other embodiments, 90 and 92 respectively, of the present invention. In FIG. 10 the waterbed mattress comprises a substantially open celled foam slab 91 which has an overall specific gravity which is greater than that of the liquid fill. Slab 91, as can be seen, has a rectangular cross section. It has been found that significant wave reduction can be achieved with this embodiment. The slab should be at least 40–50% as thick as the depth of the mattress, and preferably is about 70% as deep.

The waterbed mattress of FIG. 11 comprises slab 93 which is of egg crate design. This slab also has a specific gravity greater than that of the liquid fill. In this embodiment the total thickness of this slab should be about the same as that of slab 91. The teats 94 may comprise up to about 80% of the total thickness of the slab.

The waterbed mattress of the present invention is emptied and filled in the same manner as conventional waterbed mattresses. In filling the mattress of the embodiments shown in FIGS. 1–8, it is preferred that the liquid fill be filled to about one inch under the top of the mattress. The addition or reduction of water allows a degree of wave action adjustability. The mattress of the embodiments shown in FIGS. 10 and 11 should be filled to the top. When emptying the mattress, of couse, the liquid fill in the foam may have to be "rolled" or wrung out. However, convenient tap water rather than a viscous fluid is normally used in the present invention. Moreover, the present invention, which can be folded or rolled up, can be easily stored and shipped.

The present invention has been described in terms of its preferred embodiments. However, one skilled in the art can readily ascertain that the present invention can be easily modified to appear in substantially equivalent embodiments. For example, the present invention could be used for other fluid-filled, body supporting furniture such as chairs, sofas or couches. Further, the embodiments shown in FIGS. 7, 9 and in FIG. 11 would still function if slabs 72, 98 and 93 were positioned with teats 74, 99 and 94, respectively, extending downward.

I claim:

1. A body supporting container capable of being filled with a liquid, said container having a substantially open celled foam disposed therein, said foam extending substantially along the horizontal dimensions of said container and occupying 20 to 80 percent of the depth of the container when said container is filled, said foam having a material of low specific gravity disposed throughout its body, said material of low specific gravity causing the foam to float in the liquid, above the bottom wall of the container, close to the top wall of the container, whereby wave motion in said filled container is dampened while the desirable qualities of the liquid-filled body supporting container are retained.

2. The container of claim 1 wherein the thickness of said substantially open celled foam is 40 to 60 percent of the depth of said container when it is filled.

3. The container of claim 1 wherein said open celled foam has a specific gravity less than that of said liquid.

4. The container of claim 1 wherein said open celled foam has a specific gravity equal to that of said liquid.

5. The container of claim 1 wherein said open celled foam has a specific gravity greater than that of said liquid.

6. The container of claim 1 wherein said low specific gravity material is ground cork.

7. The container of claim 1 wherein said low specific gravity material is comprised of glass beads.

8. The container of claim 1 wherein said low specific gravity material is comprised of phenolic beads.

9. The container of claim 1 wherein said low specific gravity material is comprised of expandable polystyrene beads.

10. The container of claim 1 wherein said liquid is water and said substantially open celled foam has a specific gravity in the range of about 0.85 to 1.

11. The container of claim 1 wherein said substantially open celled foam is chiefly open celled vinyl foam.

12. The container of claim 1 wherein said substantially open celled foam is chiefly open celled polyurethane foam.

13. The container of claim 12 wherein said substantially open celled foam has an ILD number between about 8 and about 24.

14. The container of claim 1 wherein said substantially open celled foam is chiefly open celled foam rubber.

15. The container of claim 1 wherein said substantially open celled foam is chiefly open celled neoprene foam.

16. The container of claim 1 wherein said substantially open celled foam is a single foam slab.

17. The container of claim 1 wherein said substantially open celled foam disposed in said container is a plurality of foam particles.

18. The container of claim 17, wherein said plurality of foam particles is held in an inner enclosure.

19. The container of claim 1 wherein said substantially open celled foam disposed in said container is a plurality of foam pieces.

20. The container of claim 19 wherein said plurality of foam pieces is held in a gauge-like inner enclosure.

21. The container of claim 1 wherein said substantially open celled foam is a single foam slab comprising a base with projections extending upwards therefrom.

22. The container of claim 1 wherein said foam is a single foam slab of egg crate design.

23. The container of claim 22 wherein the teats of said slab of egg crate design extend upwards from said slab.

24. The container of claim 23 wherein said teats comprise about 50% of the thickness of said slab.

25. The container of claim 1 wherein said foam is in contact with the top wall of said container.

26. A waterbed mattress having dampened wave motion characteristics, said mattress comprising a watertight container and a slab of substantially open celled foam having a material of low specific gravity disposed throughout its body, said material of low specific gravity causing the foam slab to float in the water, above the bottom wall of the mattress, close to the top wall of the mattress, said slab comprising a base with tapered projections extending vertically therefrom, said projections comprising at least 50 percent of the vertical height of the slab said slab extending substantially along the horizontal dimensions of the container and occupying 20 to 80 percent of the depth of the container.

27. The water bed mattress of claim 26 wherein said projections extend upwards.

28. The waterbed mattress of claim 27, said slab of open celled foam having an egg crate design, the teats of said egg crate design being said projections.

29. The waterbed mattress of claim 26 wherein said projections extend downwards.

30. A body supporting container capable of being filled with a liquid, said container having a plurality of substantially open celled foam pieces disposed therein, said foam extending substantially along the horizontal dimensions of said container, said foam having low specific gravity material disposed therein so that the specific gravity of said substantially open celled foam is less than the specific gravity of said liquid, said plurality of foam pieces being held in an inner enclosure, said inner enclosure comprising a gauze-like material completely enclosing said plurality of foam pieces while permitting liquid transfer into and out of the inner enclosure, whereby wave motion in said filled container is dampened.

* * * * *